US008327773B2

(12) United States Patent
Hayashi

(10) Patent No.: US 8,327,773 B2
(45) Date of Patent: Dec. 11, 2012

(54) RAILWAY VEHICLE

(75) Inventor: Kentaro Hayashi, Nagoya (JP)

(73) Assignee: Nippon Sharyo, Ltd., Nagoya-shi (JP)

( * ) Notice: Subject to any disclaimer, the term of this patent is extended or adjusted under 35 U.S.C. 154(b) by 2 days.

(21) Appl. No.: 12/654,784

(22) Filed: Jan. 4, 2010

(65) Prior Publication Data

US 2011/0162555 A1 Jul. 7, 2011

(51) Int. Cl.
*B61D 15/06* (2006.01)

(52) U.S. Cl. ..... 105/392.5; 213/220; 213/221; 213/222

(58) Field of Classification Search ..... 105/392.5; 213/220, 221, 222
See application file for complete search history.

(56) References Cited

U.S. PATENT DOCUMENTS

| | | | | |
|---|---|---|---|---|
| 3,204,781 | A * | 9/1965 | La Belle | 213/221 |
| 3,253,718 | A * | 5/1966 | Anderson et al. | 213/220 |
| 3,258,134 | A * | 6/1966 | Nicolas | 213/221 |
| 6,393,999 | B1 * | 5/2002 | Schneider | 105/392.5 |
| 7,543,537 | B2 * | 6/2009 | Seitzberger et al. | 105/392.5 |
| 7,735,427 | B2 * | 6/2010 | Gansweidt | 105/392.5 |
| 7,905,366 | B2 * | 3/2011 | Jaede | 213/7 |
| 2007/0261592 | A1 * | 11/2007 | Mochida et al. | 105/392.5 |
| 2008/0041268 | A1 * | 2/2008 | Seitzberger et al. | 105/392.5 |
| 2008/0236440 | A1 * | 10/2008 | Nakamura et al. | 105/392.5 |
| 2009/0000506 | A1 * | 1/2009 | Jaede | 105/392.5 |

FOREIGN PATENT DOCUMENTS

| | | | |
|---|---|---|---|
| EP | 0529433 | A1 | 3/1993 |
| JP | S61-163774 | | 10/1986 |
| JP | S62-123463 | | 8/1987 |
| JP | H07-006025 | | 1/1995 |
| JP | 2001-048016 | A | 2/2001 |
| JP | 2001-260881 | A | 9/2001 |
| JP | 2008-247256 | A | 10/2008 |

OTHER PUBLICATIONS

Office Action for Japanese Patent Application No. 2007-164532 dated Jan. 25, 2011.
Office Action for Japanese Patent Application No. 2007-164532 dated Jun. 8, 2010.

* cited by examiner

*Primary Examiner* — Jason C Smith
(74) *Attorney, Agent, or Firm* — Edwards Wildman Palmer LLP

(57) ABSTRACT

A slide structure 21 of a railway vehicle includes a slide end beam 22 disposed in front of an end beam 16 that constitutes a portion of a body, and a slide center beam 23 projecting rearward of the slide end beam. An underframe 12 is provided with a guide portion 24 that guides the slide center beam in the longitudinal direction of the body. The underframe 12 is also provided with a holding member 28 that holds the slide center beam at a front position of the body with respect to the guide portion. The holding member has such a tensile strength that the holding member couples the underframe and the slide structure to each other in the longitudinal direction of the body and the holding member is broken when a tensile load in a rearward direction of the body applied from the slide structure to the holding member exceeds a preset tensile load, thereby permitting the slide structure to move in the rearward direction of the body. An impact absorbing member 29 is disposed between the underframe and the slide structure.

10 Claims, 4 Drawing Sheets

RAILWAY VEHICLE

FIELD OF INVENTION

The present invention relates to a railway vehicle, and more particularly, to a railway vehicle having an impact absorbing structure that absorbs impact energy caused at the time of collision of a front end of the railway vehicle to prevent a rear portion of the body from being largely damaged or deformed.

BACKGROUND ART

As such a railway vehicle, there is a known railway vehicle having an impact absorbing structure in which the vehicle end is provided with a high rigidity collision member to moderate an impact caused at the time of collision especially at the time of collision between vehicles, a high rigidity lateral beam is provided between vertical beams, and an impact absorbing member that is plastically deformed to moderate an impact caused at the time of collision is disposed between the collision member and the lateral beam (see Japanese Patent Application Laid-open No. 2001-48016, for example).

[Patent documents 1] Japanese Patent Application Laid-open No. 2001-48016

SUMMARY OF THE INVENTION

Problem to be Solved by the Invention

According to the conventional impact absorbing structure also, it is possible to absorb an impact caused at the time of collision by contriving a shape and a layout of a member. However, when a portion of an element that constitutes a front end body structure is designed as an impact absorbing member, a complicated condition is required for easily deforming a structure of that portion as desired at the time of collision while satisfying a normal static load condition.

Further, there is an adverse possibility that the conventional structure is deformed under a load smaller than a prescribed value depending upon a stress state immediately before collision or depending upon a direction of the load, or unexpected moment of deformation is generated. In such a case, not only a conceivable amount of energy can not be absorbed, but also a risk of secondary disaster such as expansion of damage toward a compartment and derail is increased. A size of an impact absorbing member of a front surface of the vehicle is limited if a size of a body is taken into account, and an amount of energy that can be absorbed is also limited.

Hence, it is an object of the present invention to provide a railway vehicle having an impact absorbing structure capable of reliably absorbing an impact when a given or higher collision load is received, and in which an impact absorbing member is separated from a structure constituting element to specialize in the impact absorbing ability, and a load caused at the time of collision is applied to the impact absorbing member from a given direction to efficiently absorb an impact.

Means for Solving the Problems

To achieve the above object, the present invention provides a railway vehicle in which a slide structure that slides in a rearward direction of a body at the time of collision is disposed at a front portion in the body, wherein the slide structure includes a slide end beam disposed at a front position of the body, and a slide center beam projecting rearward of the slide end beam, the body includes a guide portion that guides the slide center beam in a longitudinal direction of the body, and a holding member that holds the slide structure at a front position of the body, and the holding member has such a tensile strength that the holding member couples the body and the slide structure to each other in the longitudinal direction of the body and the holding member is pulled and broken when a tensile load in a rearward direction of the body applied from the slide structure to the holding member exceeds a preset tensile load, thereby permitting the slide structure to move in the rearward direction of the body.

In the railway vehicle of the invention, an impact absorbing member is provided between the body and the slide structure, wherein the impact absorbing member is deformed when the slide structure moves in the rearward direction of the body, thereby absorbing moving energy of the slide structure in the rearward direction of the body.

The holding member comprises a plurality of connecting plates, and an intermediate portion of each of the connecting plates is provided with a breakage portion having a cross-sectional area smaller than those of both ends of the connecting plate. The slide center beam includes slide portions respectively projecting in both widthwise directions of the body, inclined slide surfaces whose upper portions are spread are provided on lower surfaces of the slide portions, and the guide portion includes an inclined guide surface that supports the inclined slide surface from below such that the inclined slide surface can move in the longitudinal direction of the body.

EFFECTS OF THE INVENTION

According to the railway vehicle of the present invention, the holding member is pulled and broken only when a load exceeding a tensile strength is applied to the holding member by collision, and a slide center beam of the slide structure is guided by a guide portion, and the slide structure moves straightly in the rearward direction of the body. A portion of the body is deformed as the slide structure moves rearward of the body and with this, the collision energy can be absorbed. Since the holding member is broken under a tensile load, the holding member can reliably be broken under a given load by setting a cross-sectional area of the holding member in accordance with a tensile strength of a material to be used. Further, the impact absorbing member is deformed in a given direction with moving energy of the slide structure that moves straightly in the rearward direction of the vehicle by disposing the impact absorbing member between the body and the slide structure. Therefore, it is possible to extremely effectively and reliably absorb the impact energy by the impact absorbing member.

MODE FOR CARRYING OUT THE INVENTION

Figure 1:
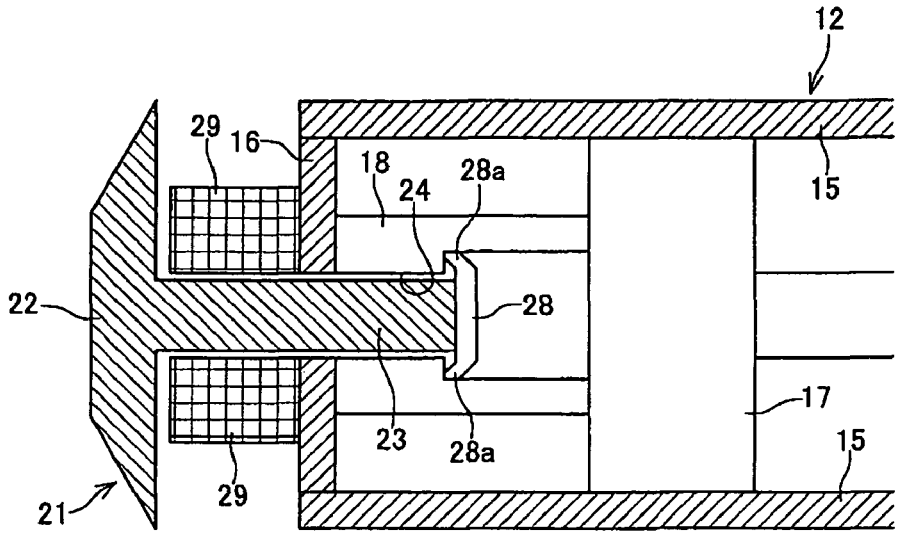
FIG. 1 is a schematic plan view of an impact absorbing structure showing one embodiment of a railway vehicle according to the present invention.
Figure 2:
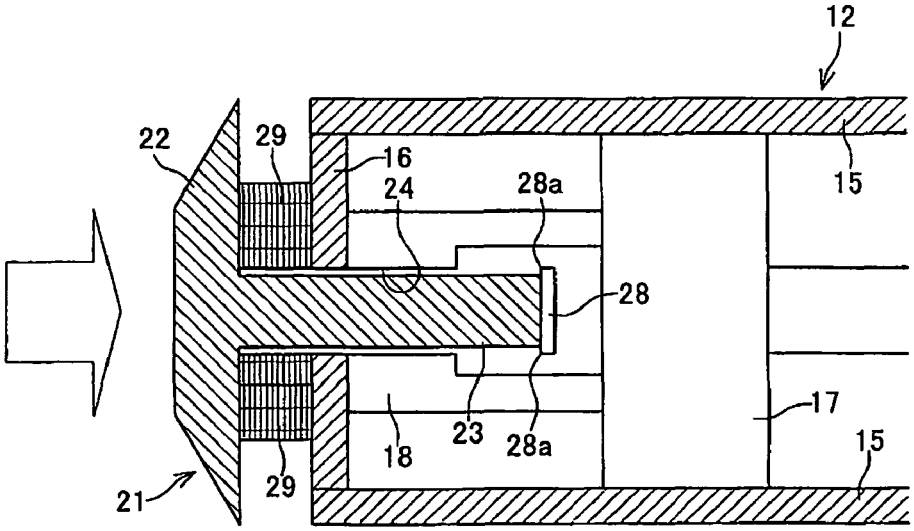
FIG. 2 is a schematic plan view of an essential portion showing a state where the impact absorbing structure is deformed at the time of collision.
Figure 3:
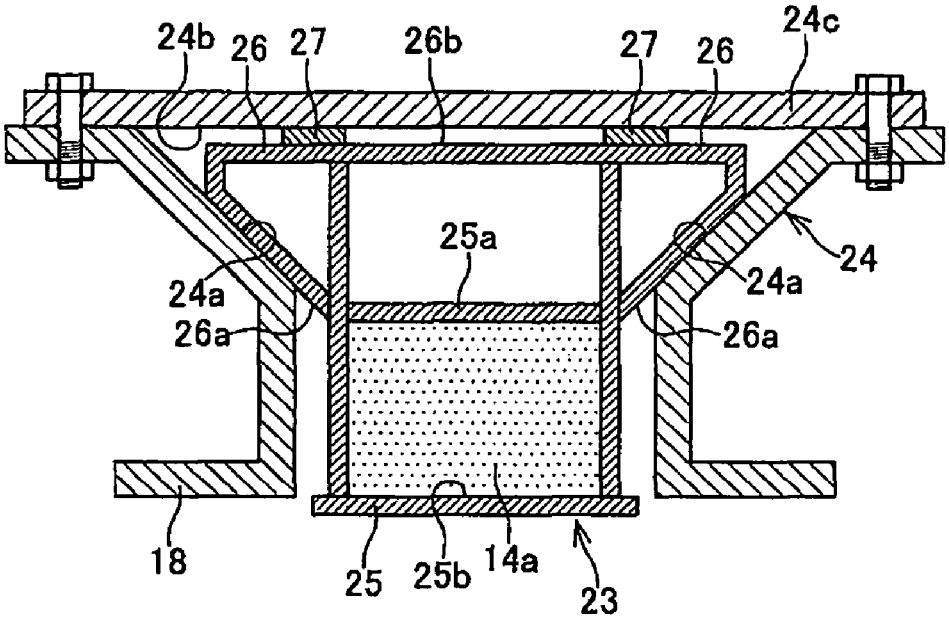
FIG. 3 is a sectional front view showing a relation between a slide center beam and a guide portion.
Figure 4:
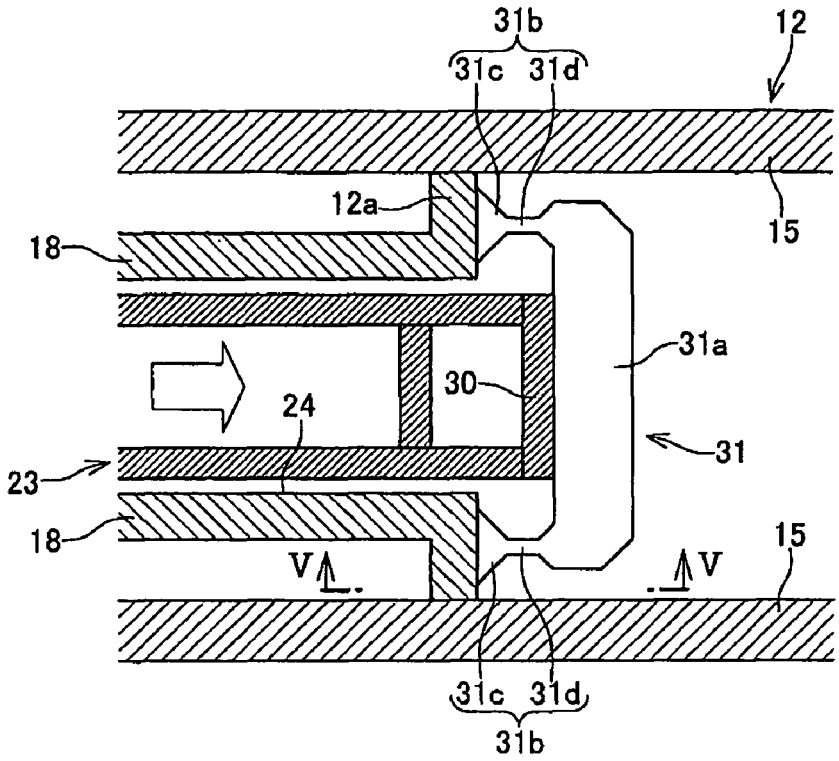
FIG. 4 is a schematic plan view of an essential portion showing one example of a holding member provided between a body and a slide structure.
Figure 5:
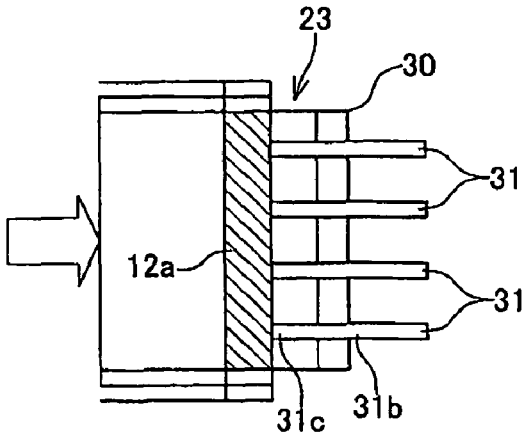
FIG. 5 is a sectional view taken along the line V-V in FIG. 4.
Figure 6:
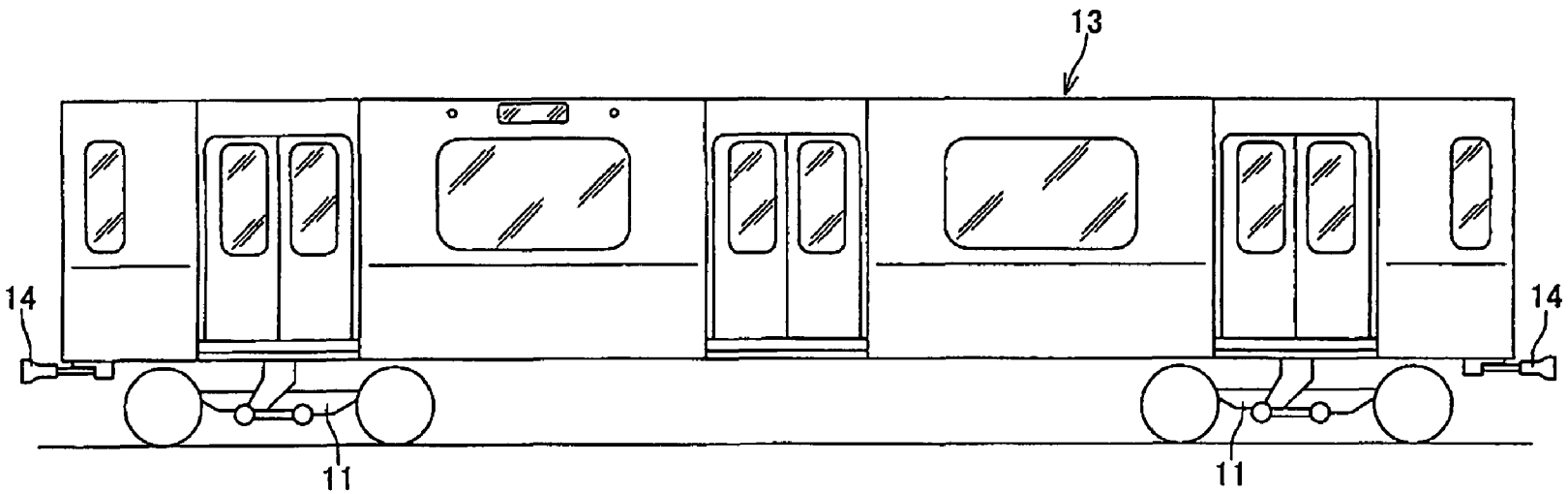
FIG. 6 is a side view showing one example of the railway vehicle.

The drawings show one embodiment of a railway vehicle according to the present invention, wherein FIG. 1 is a schematic plan view of an essential portion showing an impact absorbing structure, FIG. 2 is a schematic plan view of an essential portion showing a state where the impact absorbing structure is deformed at the time of collision, FIG. 3 is a sectional front view showing a relation between a slide center beam and a guide portion, FIG. 4 is a schematic plan view of an essential portion showing one example of a holding member provided between a body and a slide structure, FIG. 5 is a sectional view taken along the line V-V in FIG. 4, and FIG. 6 is a side view showing one example of the railway vehicle.

According to the railway vehicle, a body 13 is formed by bonding a side structure, a roof structure and an end structure in combination on an upper portion of an underframe 12 on which trucks 11 are mounted. Couplers 14 are provided on both front and rear ends of the railway vehicle. The underframe 12 includes a pair of left and right side beams 15, a pair of end beams 16 disposed on both front and rear ends of the side beams 15, front and rear two bolster beams 17 and a plurality of lateral beams (not shown) disposed in a bolster direction at predetermined locations on inner sides of the end beams 16, and center beams 18 that are provided in the direction of rails for receiving a load of the couplers 14.

The underframe 12 constitutes a front end of the body 13. The front end of the underframe 12 is provided with a slide structure 21 that projects forward from the end beam 16. The slide structure 21 is a member having a T-shape as viewed from above, and the slide structure 21 includes a slide end beam 22 disposed in front of the end beam 16 in parallel to the end beam 16, and a slide center beam 23 projecting rearward from a central portion of the slide end beam 22. The slide structure 21 has a strength and a structure of such a degree that energy from front applied to the slide end beam 22 at the time of collision can be converted into energy for moving the slide center beam 23 rearward.

The center beam 18 of the underframe 12 is provided with a guide portion 24 for guiding the slide center beam 23 in the longitudinal direction of the body. The slide center beam 23 moves the body rearward by collision energy transmitted from the slide end beam 22 to the slide center beam 23. The guide portion 24 guides the slide center beam 23, thereby reliably moving the slide structure 21 rearward of the body.

The slide center beam 23 includes a polycylindrical main body 25 having an axis disposed in the longitudinal direction of the body, and slide portions 26 projecting both upper sideway of the main body 25. The main body 25 is vertically partitioned by a reinforcing plate 25*a* that is provided in the horizontal direction at an intermediate portion in the vertical direction. A base unit 14*a* of the coupler 14 is inserted into a lower section 25*b*. A lower surface of each of the slide portions 26 is provided with an inclined slide surface 26*a* having an inclined surface whose upper portion is spread. A horizontal upper slide surface 26*b* is provided on upper surfaces of the main body 25 and the slide portions 26.

The guide portion 24 includes a pair of inclined guide surfaces 24*a* on which the inclined slide surfaces 26*a* respectively slide, and an upper guide surface 24*b* that is opposed to the upper slide surface 26*b*. The guide portion 24 has such a structure that an upper portion of the guide portion 24 is opened when the underframe is manufactured, and after the slide center beam 23 is assembled from above, a lid plate 24*c* is fixed to an upper surface of the underframe 12, thereby accommodating the slide center beam 23 in the guide portion 24 such that the slide center beam 23 can move. A lower surface of the lid plate 24*c* is the upper guide surface 24*b*. A plate-like sliding member 27 is provided between the upper slide surface 26*b* and the upper guide surface 24*b*. Both the inclined surfaces 24*a* and 26*a* and the sliding member 27 are brought into a state where they are always in abutment against each other and with this, vibration of the slide structure 21 under its normal state is suppressed.

The load of the slide structure 21 is supported by abutment between the inclined slide surfaces 26*a* and the inclined guide surfaces 24*a* in this manner. With this, even if there is a slight error in work dimension of each member, the slide structure 21 can be held at a predetermined position, contact portions between the slide center beam 23 and the guide portion 24 can be limited to both the inclined surfaces 24*a* and 26*a* and the sliding member 27, friction can be reduced and the slide structure 21 can reliably and smoothly move rearward at the time of collision.

When the vehicle runs normally or another vehicle is coupled to this vehicle, the underframe 12 and the slide structure 21 are strongly connected to each other by means of a holding member 28 and this connected state is held by the holding member 28. When the vehicle collides, the holding member 28 is broken to permit the slide structure 21 to move in the rearward direction of the body. An impact absorbing member 29 is provided between the underframe 12 and the slide structure 21. At the time of collision, the impact absorbing member 29 is compressed and deformed when the slide structure 21 moves in the rearward direction of the body with respect to the underframe 12, and the impact absorbing member 29 absorbs the impact energy.

The impact absorbing member 29 is provided such that it is independent from members that support a load applied to the vehicle in the normal state, and the impact absorbing member 29 only has a function for absorbing energy at the time of collision. Since the moving direction of the slide structure 21 at the time of collision is limited to the rearward direction of the body by the slide center beam 23 and the guide portion 24, the impact absorbing member 29 can be deformed equally by a compression load in the longitudinal direction of the body. That is, a structure that can handle only the compression load in the longitudinal direction of the body can be employed without taking various directions of the load into consideration. Therefore, it is possible to obtain a sufficient impact absorbing ability with a simple structure that is small enough to fit in the body.

The holding member 28 connects the underframe 12 and the slide structure 21 with each other in the longitudinal direction of the body. A breakage portion 28*a* is provided on an intermediate portion of the holding member 28 in its longitudinal direction. The breakage portion 28*a* has a cross-sectional area smaller than those of both ends of the holding member 28 that are fixed to the underframe 12 and the slide structure 21. The holding member 28 is formed such that the holding member 28 holds the slide center beam 23 (slide structure 21) at a predetermined front position of the body under the normal state as shown in FIG. 1, and the breakage portion 28*a* is broken at the time of collision, and the slide structure 21 moves rearward while deforming the impact absorbing member 29 as shown in FIG. 2.

As shown in FIGS. 4 and 5, the holding member 28 can be formed from a plurality of connecting plates 31 held by a holding member 30 provided at a rear end of the slide center beam 23. Each connecting plate 31 is a plate member having a U-shape as viewed from above. The connecting plate 31 has a fixing plate 31*a* fixed to the holding member 30, and connecting portions 31*b* extending from both sides of the fixing plate 31*a* in a direction of sleepers toward front of the body. A tip end 31*c* of each connecting portion 31*b* is strongly fixed to the lateral beam or the center beam provided on the underframe 12 or a rear side of a special holding member connection beam 12*a* by means of welding or a bolt. A narrow breakage portion 31*d* is provided at an intermediate portion of the connecting portion 31*b*. The breakage portion 31*d* has a cross-sectional area smaller than those of the fixing plate 31*a* of the connecting portion 31*b* or the tip end 31*c* fixed to the underframe 12.

A total cross-sectional area of the breakage portions 31*d* provided on the connecting plates 31 is set such that it is possible to obtain such a tensile strength that all of the breakage portions 31*d* are broken substantially at the same time when a tensile load in the rearward direction of the body applied from the slide structure 21 to the holding member 30 exceeds a preset tensile load.

This will be explained using relative numerical values. That is, if a tensile strength of all of the breakage portions that is required in the normal state is defined as [100], the total cross-sectional area may be set such that even if tensile strength of [100] is applied, the breakage portions 31*d* are not broken, and when a tensile load of [120] is applied at the time of collision, the breakage portions 31*d* are broken. At that time, when four connecting plates 31 are used as shown in FIGS. 4 and 5, since the total number of the breakage portions 31*d* is eight, each breakage portion 31*d* should have a tensile strength of [15]. Therefore, it is unnecessary to use a large-scale member as the holding member 28, and a plate material for general purpose use can be used.

Since a tensile strength that is inherent in each material is utilized, design and adjustment for breaking the breakage portions with predetermined stress can easily be carried out as compared with a case where a shear strength or a bending strength is utilized, and the holding member 28 can reliably be broken at the time of collision. With this, the slide structure 21 reliably operates, the impact absorbing member 29 can reliably absorb energy, and it is possible to avoid a risk of secondary disaster such as expansion of damage toward a compartment and derail. Further, since the holding member 28 is formed from the connecting plates 31 that are plate materials as described above, it is easy to adjust a movement-starting load of the slide structure 21 by changing the number and thickness of the connecting plates 31 in accordance with various conditions such as a weight of a vehicle and the maximum number of vehicles to be coupled.

The impact absorbing structure is applied mainly to a center beam of an underframe that transmits a load of a coupler, but the similar impact absorbing structure can also be employed for a side upper portion and a roof of a body as required. It is only necessary that the holding member has such a structure that the holding member is broken with a tensile load, and a position of the holding member is not limited. For example, if a slide structure and an underframe are connected to each other through bolts provided in a direction of rails at an appropriate position and material and diameter of the bolts are selected such that the bolts are broken with a predetermined load, such a holding member can be utilized as that above-described holding member. Further, an installation position of the impact absorbing member can arbitrary be selected, the impact absorbing member can be provided between a slide center beam and a bolster beam for example, the impact absorbing members can be provided at a plurality of locations, and a plurality of impact absorbing members can be provided such that they are deformed in a stepwise manner.

Description Of Symbols

11 truck
12 underframe
12*a* holding member connection beam
13 body
14 coupler
14*a* base unit
15 side beam
16 end beam
17 bolster beam
18 center beam
21 slide structure
22 slide end beam
23 slide center beam
24 guide portion
24*a* inclined guide surface
24*b* upper guide surface
24*c* lip plate
25 main body
25*a* reinforcing plate
25*b* lower section
26 slide portion
26*a* inclined slide surface
26*b* upper slide surface
27 sliding member
28 holding member
28*a* breakage portion
29 impact absorbing member
30 holding member
31 connecting plate
31*a* fixing plate
31*b* connecting portion
31*c* tip end
31*d* breakage portion

The invention claimed is:

1. A railway vehicle in which a slide structure that slides in a rearward direction of a body of the railway vehicle at a time of collision is disposed at a front portion of the body, wherein the slide structure includes a slide end beam disposed at the front position of the body, and a slide center beam projecting rearward of the slide end beam, the body of the railway vehicle includes a guide portion that guides the slide center beam in a longitudinal direction of the body, and a holding member connected to the body such that the holding member holds the slide structure at the front position of the body by abutting a rearward end of the slide structure whereby the rearward end of the slide structure does not extend beyond the holding member at a most rearward point of the holding member, and the holding member has a unitary structure and is connected to the body of the railway vehicle in such an orientation that a load applied to the holding member by the slide structure is a tensile load and the holding member has such a tensile strength that the holding member couples the body and the slide structure to each other in the longitudinal direction of the body and the holding member is pulled apart in a direction longitudinal to the body of the railway vehicle and is broken when the tensile load in the rearward direction of the body applied from the slide structure to the holding member exceeds a preset tensile load, thereby permitting the slide structure to move in the rearward direction of the body.

2. The railway vehicle according to claim 1, wherein an impact absorbing member is provided between the body and the slide structure, wherein the impact absorbing member is deformed when the slide structure moves in the rearward direction of the body, thereby absorbing moving energy of the slide structure in the rearward direction of the body.

3. The railway vehicle according to claim 2, wherein the holding member comprises a plurality of connecting plates, and an intermediate portion of each of the connecting plates is provided with a breakage portion having a cross-sectional area smaller than those of both ends of the connecting plate.

4. The railway vehicle according to claim 3, wherein the slide center beam includes slide portions respectively projecting in both widthwise directions of the body, inclined slide surfaces whose upper portions are spread are provided on lower surfaces of the slide portions, and the guide portion includes an inclined guide surface, which receives and slidably engages with an inclined slide surface, the inclined guide surface supporting the inclined slide surface from below such that the inclined slide surface can move in the longitudinal direction of the body.

5. The railway vehicle according to claim 1, wherein the holding member comprises a plurality of connecting plates, and an intermediate portion of each of the connecting plates is provided with a breakage portion having a cross-sectional area smaller than cross-sectional areas of both ends of the connecting plate.

6. The railway vehicle according to claim 2, wherein the slide center beam includes slide portions respectively projecting in both widthwise directions of the body, inclined slide surfaces whose upper portions are spread are provided on lower surfaces of the slide portions, and the guide portion includes an inclined guide surface, which receives and slidably engages with an inclined slide surface, the inclined guide surface supporting the inclined slide surface from below such that the inclined slide surface can move in the longitudinal direction of the body.

7. The railway vehicle according to claim 1, wherein the slide center beam includes slide portions respectively projecting in both widthwise directions of the body, inclined slide surfaces whose upper portions are spread are provided on lower surfaces of the slide portions, and the guide portion includes an inclined guide surface, which receives and slidably engages with an inclined slide surface, the inclined guide surface supporting the inclined slide surface from below such that the inclined slide surface can move in the longitudinal direction of the body.

8. The railway vehicle according to claim 5, wherein the slide center beam includes slide portions respectively projecting in both widthwise directions of the body, inclined slide surfaces whose upper portions are spread are provided on lower surfaces of the slide portions, and the guide portion includes an inclined guide surface, which receives and slidably engages with an inclined slide surface, the inclined guide surface supporting the inclined slide surface from below such that the inclined slide surface can move in the longitudinal direction of the body.

9. A railway vehicle including a slide structure that slides in a rearward direction of a railway vehicle body at a time of collision, wherein, the slide structure is disposed at a front portion of the body and includes a slide end beam disposed at the front of the railway vehicle body, and a slide center beam projects rearward of the slide end beam and includes a plurality of inclined slide surfaces;

the railway vehicle body includes a guide portion that guides the slide center beam in a longitudinal direction of the vehicle body, the guide portion including a plurality of inclined guide surfaces that receive and slidably engage the plurality of inclined slide surfaces;

a holding member connected to the body such that the holding member holds the slide structure at the front position of the body by abutting a rearward end of the slide structure whereby the rearward end of the slide structure does not extend beyond the holding member at a most rearward point of the holding member, and the holding member has a unitary structure and is connected to the body of the railway vehicle in such an orientation that a load applied to the holding member by the slide structure is a tensile load and the holding member includes a plurality of connecting plates, each having a preset tensile strength and each being coupled to the vehicle body and the slide structure in a longitudinal direction of the vehicle body, wherein when a force exceeding the preset tensile strength of the holding members is applied in a rearward direction upon the slide structure, the holding member is pulled apart in a direction longitudinal to the body of the railway vehicle and breaks to permit the slide structure to move in the rearward direction of the vehicle body.

10. A railway vehicle in which a slide structure that slides in a rearward direction of a body of the railway vehicle at the time of a collision is disposed at a front portion in the body, wherein the slide structure includes a slide end beam disposed at the front position of the body, and a slide center beam projecting rearward of the slide end beam, the body of the railway vehicle includes a guide portion which is provided on facing surfaces of a pair of center beams that are provided in the direction of rails between an end beam and a bolster beam and which guides the slide center beam in a longitudinal direction of the body, and a holding member which is provided at a rear end of the slide center beam and which couples the body and the slide structure to each other in the longitudinal direction of the body to hold the slide structure at the front position of the body by abutting a rearward end of the slide structure whereby the rearward end of the slide structure does not extend beyond the holding member at a most rearward point of the holding member, and the holding member comprises a plurality of connecting plates each having a unitary structure and each being connected to the body of the railway vehicle in such an orientation that a load applied to each connecting plate by the slide structure is a tensile load, each connecting plate which has a U-shape as viewed from above includes a fixing plate fixed to the holding member, and connecting portions extending from both sides of the fixing plate in a direction of sleepers toward front of the body, an intermediate portion of each of the connecting plates is provided with a breakage portion having a cross-sectional area smaller than those of the fixing plate of the connecting portion and the tip end fixed to the guide portions, and the breakage portion is set such that it is possible to obtain such a tensile strength that all of the breakage portions are pulled apart in a direction longitudinal to the body of the railway vehicle and are broken substantially at the same time.

* * * * *